US005452593A

United States Patent [19]

Derick

[11] Patent Number: 5,452,593

[45] Date of Patent: Sep. 26, 1995

[54] LOOP TENSION RELEASE NOTCH TO ASSIST LATCH CLOSING

[75] Inventor: Peter Derick, Quebec, Canada

[73] Assignee: Exeltor Inc., Bedford, Canada

[21] Appl. No.: 250,512

[22] Filed: May 27, 1994

[30] Foreign Application Priority Data

May 28, 1993 [DE] Germany ..... 43 17 782.4

[51] Int. Cl.[6] ..... D04B 35/04

[52] U.S. Cl. ..... 66/121

[58] Field of Search ..... 66/121

[56] References Cited

U.S. PATENT DOCUMENTS

| | | | |
|---|---|---|---|
| 246,090 | 8/1881 | Daniels | 66/121 |
| 473,697 | 4/1892 | Egly | 66/121 |
| 664,808 | 12/1900 | Dodge | 66/121 |
| 749,686 | 1/1904 | Egly | 66/121 |
| 1,168,039 | 1/1916 | Swinglehurst | 66/121 |
| 2,536,478 | 1/1951 | Vitoux | 66/121 X |
| 2,699,053 | 1/1955 | Noe | 66/121 |
| 3,550,401 | 12/1970 | Buck | 66/121 |
| 3,583,179 | 6/1971 | Buck | 66/121 |
| 4,548,056 | 10/1985 | Schuler et al. | 66/121 |

FOREIGN PATENT DOCUMENTS

| | | | |
|---|---|---|---|
| 18890 | 3/1884 | Canada . | |
| 611000 | 10/1960 | Italy | 66/121 |
| 279859 | 1/1971 | U.S.S.R. | 66/121 |

OTHER PUBLICATIONS

Groz–Beckert, Needles of High Precision, pp. 33,34 nos. 44,48. no date of publication (adress of company printed in literature is W. Germany—prior to 1991 due to change of country standing).

*Primary Examiner*—John L. Calvert
*Attorney, Agent, or Firm*—Fish & Richardson

[57] ABSTRACT

A knitting needle and method for making the knitting needle are disclosed. The knitting needle comprises a shank having a head portion, a butt end portion, and a blade therebetween. The head portion has a cheek portion, a latch pivotally secured in the cheek portion, and a hook adjacent to the cheek portion. The blade having a front side portion parallel to a rear side portion, and a loop tension release notch portion between the front side portion and the cheek portion. The loop tension release notch portion is formed below a plane formed by the front side portion. In another embodiment, the loop tension release notch portion is formed of a continuous curvature in a taper mill needle. The method includes forming a needle having a head portion including a cheek portion and a hook adjacent to the cheek portion, and a blade having a reduced height front side portion parallel to a rear side portion. The method also includes forming a loop tension release notch portion between the reduced height front side portion and the cheek portion. The loop tension release notch portion is formed below a plane formed by the reduced height front side portion for a straight mill needle and is formed of a continuous curvature for a taper mill needle.

24 Claims, 3 Drawing Sheets

LOOP TENSION RELEASE NOTCH TO ASSIST LATCH CLOSING

BACKGROUND OF THE INVENTION

1. Field of the Invention

This invention concerns knitting needles used in automatic knitting machines. In particular, this invention relates to a knitting needle capable of making hosiery, underwear fabric, outerwear fabric and industrial fabric.

2. Discussion of the Related Art

There are many known types of knitting needles which include latches. A common problem in knitting with conventional latch needles in automatic knitting machines is the spearing of the yarns when the stitch closes the latch before being cast off. In order to understand the source of this problem, a brief description of the knitting cycle follows.

A new yarn is laid under the hook of the needle by moving the needle into a position so that the hook passes the yarn carrier with the latch in the open position. The sideways motion of the needle accomplishes this positioning. The stitch of the previous course (the old stitch) is located on the blade or round out of the needle. The needle is then pulled backwards. The old stitch slides under the tip of the latch and moves the latch into the closed position. In the next part of the cycle, the new stitch opens the latch. In most instances, the tip of the latch is away from the blade of the needle and the old stitch has no problem sliding under the latch to close it. In some instances, however, the old stitch will not be able to slide under the latch and a problem commonly referred to as "spearing" occurs. "Spearing" especially occurs when needles have been used for a while and the latch seat has been worn deeper. The latch seat becomes particularly worn when knitting Lycra yarns, but does occur in all knitting situations.

Spearing can cause two different types of defects. First, it can jam the knitting cycle and permanently damage the knitting needle or, there may be a complete or partial dropped stitch depending on how much of the yarn in the old stitch climbs above the needle and how much of the old stitch slides under the latch.

When the needle is moved backwards, the old stitch is under considerable tension caused by the friction between steel and yarn. This tension contributes to the above-noted problem of spearing when the old stitch comes in contact with the sharp point of the latch.

Other concerns that arise are yarn breakage due to the high tension in the loop when the needle is moving backwards. Furthermore the yarn tension increases when the stitch or loop has to travel over an increased cross-section of the needle. The higher the tension in the loop the firmer the contact with the latch and hence an increased latch speed closing when contact occurs.

When the latch tip makes contact with the hook tip it bounces back until the stitch forces it back down again. This bouncing particularly with lighter yarn can interfere with a smooth cast off. This can affect fabric quality and even lead to yarn malfunctions and fabric faults.

Another problem which arises is with the pickup clearance of the needle. The pickup clearance of a needle is determined by the size of the yarn. Generally, the larger the yarn size, the higher the pickup clearance required. If there is not a sufficient pickup clearance, the yarn will snag on the latch rather than slip under the latch as necessary. As a result, an unwanted tuck stitch will occur, the needle will jam, and/or the stitch will be damaged.

Previous attempts to solve these problems have been to reduce the roundout height and/or increase the cheek height. However, increasing the cheek height forces the stitch into undesirable degrees of stretch. Additionally, reducing the blade height or roundout height for some distance reduces the resistance to flexing when the needle is in the raised position.

SUMMARY OF THE INVENTION

In order to solve the problems related to spearing, dropping a stitch and jamming of the needle, the present invention has provided a latch needle with a loop tension release notch to assist in the latch closing operation.

This invention is useful for high speed needles for circular or weft knitting machines. Needles of this invention can be used in the ladies hosiery industry.

In fine gauge needles for producing hosiery, underwear fabric, outerwear fabric, upholstery fabric and other industrial fabric, one must consider the proper functioning of the needle to produce high quality, uniform fabric as well as durability of the needle to do so reliably for a long period of time.

The loop tension release notch of the present invention allows the needle to do this. It prevents undue flexing of the needle by only reducing the cross-section of the needle for a short distance. It provides exceptionally good results in preventing spearing.

Additionally, the present invention appears to delay the closing of the latch sufficiently to minimize the latch scissoring the new yarn between the latch blade and the cheek surface.

It has been determined that the loop tension release notch of the present invention should be as deep as possible as well as being as short as possible. It is also desirable for the deepest portion of the notch to be located close to the longitudinal position of the latch tip when the latch tip is in the open position.

When designing the loop tension release notch, the constraining considerations include that the stitch must move over the surface of the needle at speeds up to 10 feet per second. Therefore, abrupt changes in cross section have to be limited so that the stitch is not unduly stretched or the yarn ruptured. The size of the yarn to be knit is an important consideration in the notch's design.

The latch needle of the present invention has two embodiments. The first embodiment is for straight mill needles and the notch is in the substantially rectilinear portion of the roundout or blade. When knitting underwear or outer wear fabric and the notch is relatively shallow (i.e., having a circular segment with a 6 mm radius and 0.5 mm deep), the edges can be blended without further design changes. But if the notch is deeper or when knitting finer yarns such as 10 to 100 denier yarn for hosiery, it is desirable to redesign the substantially rectilinear portion and angle the two line segments in front and in back of the notch so that they blend tangentially to the curved segments of the notch.

According to this embodiment of the invention, a knitting needle for knitting machines comprises a shank having a head portion, a butt end portion, and a blade therebetween. The head portion having a cheek portion, a latch pivotally secured in the cheek portion, the latch having a latch tip, and a hook adjacent to the cheek portion. The blade having a front side portion parallel to a rear side portion, and a loop tension release notch portion between the front side portion and the cheek portion. The loop tension release notch portion is formed below a plane formed by the front side portion.

The second embodiment relates to taper mill needles. In this embodiment, a high speed needle for circular knitting machines, comprises a shank having a head portion, a butt end portion, and a blade therebetween. The head portion has a cheek portion, a latch pivotally secured in the cheek portion, and a hook adjacent to the cheek portion. The blade has a top side portion parallel to a rear side portion, a tapered section adjacent to the top side portion, and a loop tension release notch portion between the tapered portion and the cheek portion. The loop tension release notch portion is formed of a continuous curvature.

The loop tension release portion is also designed so that it has a depth which is greatest at a location below the latch tip when the latch tip is in an open position. The loop tension release notch portion has a maximum depth ranging from 0.05 mm to 1.5 mm depending on the type of yarn to be used. For hosiery needles, this depth is preferably, from 0.05 mm to 0.50 mm. For other types of needles, this depth is from 0.1 mm to 1.5 mm.

Another way of determining the depth of the notch is based on the amount of the remaining material left between the maximum depth of the notch and the rear portion of the needle. It has been found that this distance can be 0.55 or less. This amount of remaining material is smaller than other prior art needles.

Another method of determining the depth of the notch according to the present invention is based on the amount of the remaining material left between the maximum depth of the notch and the rear portion of the needle relative to the cheek height. It has been found that a distance between a maximum depth of said loop tension release notch and the rear side portion that is less than 65% of the height of the cheek is preferable.

A loop tension release notch according to the present invention has among its advantages: prevention of "spearing" reduction or release of yarn tension, reduction of latch tip speed, lowering of latch standing while maintaining the standard pickup clearance, and smoother transfer of the stitch during cast off.

The present invention prevents "spearing" due to a worn latch seat by providing a small notch in the blade portion of the needle below the tip of the latch when the latch is in the open position. Positioning the notch just before or below the tip of the latch allows the yarn to slip under the latch much easier than if there was no change in the dimension of the needle at that point. Thus, the yarn is able to slip below the latch to assist in latch closing with considerable ease.

Furthermore, having the notch located below the tip of the latch ensures that the yarn is able to slip under the latch and is not snagged or "speared" on the tip of the latch because a sufficient pickup clearance is provided. The pickup clearance of the invention is provided by the latch standing in combination with the notch in the roundout portion. Thus, although thicker yarns may be used with a needle of this invention, the pickup clearance is not required to be changed because the notch accommodates the thicker yarns.

Further by providing a loop tension release notch, the yarn tension in the loop is momentarily released or decreased and the tension on the fabric is likewise reduced. Since needles work side by side this provides slack which the neighboring stitch can use when it is stretched climbing the cheek of its associated needle.

Momentarily delaying the stitch in a tension release notch reduces this latch speed but also changes the timing of the closing of the latch. The beneficial effect accomplished here is a reduction in the scissoring of the new yarn laid under the hook, and a reduction of wear on both the hook tip and latch tip.

Also, by reducing yarn tension, the latch speed is reduced. Because the yarn tension is reduced, the tension transferred from the yarn to the latch when the yarn slips into the notch under the latch to assist the latch in closing is less. As a result, the latch does not travel to its closed position with as great a speed and the stitch to be cast off is smoothly cast off. Thus, there is less chance of improper cast off, jamming of the needle, and stretched or deformed stitches.

The present invention also relates to the method of making a knitting needle for knitting machines. For straight mill needles this method includes forming a needle having a head portion including a cheek portion and a hook adjacent to the cheek portion, and a blade having a reduced height front side portion parallel to a rear side portion; and forming a loop tension release notch portion between the reduced height front side portion and the cheek portion, the loop tension release notch portion being formed below a plane formed by the reduced height front side portion. For taper mill needles, this method includes forming a needle having a head portion including a cheek portion and a hook adjacent to the cheek portion, and a blade having a tapered height front side portion; and forming a loop tension release notch portion between the tapered height front side portion and the cheek portion, the loop tension release notch portion being formed so as to have a continuous curvature.

In both embodiments, the loop tension release notch can be formed by any of the following processes: stamping, shearing, striking, pressing, milling, grinding, shaving, cutting, sand blasting and chemical metal removal methods. The various cutting methods include laser cutting, electron beam cutting and wire cutting methods.

BRIEF DESCRIPTION OF THE DRAWINGS

The above objects and features of the present invention will be apparent to those skilled in the art from the following description of the preferred embodiments thereof when considered in conjunction with the appended drawings in which.

DETAILED DESCRIPTION OF THE PREFERRED EMBODIMENTS

We shall next explain embodiments of this invention with reference to the appended drawings, FIGS. 1–4. However, the present invention is not limited to these examples.

Figure 1:
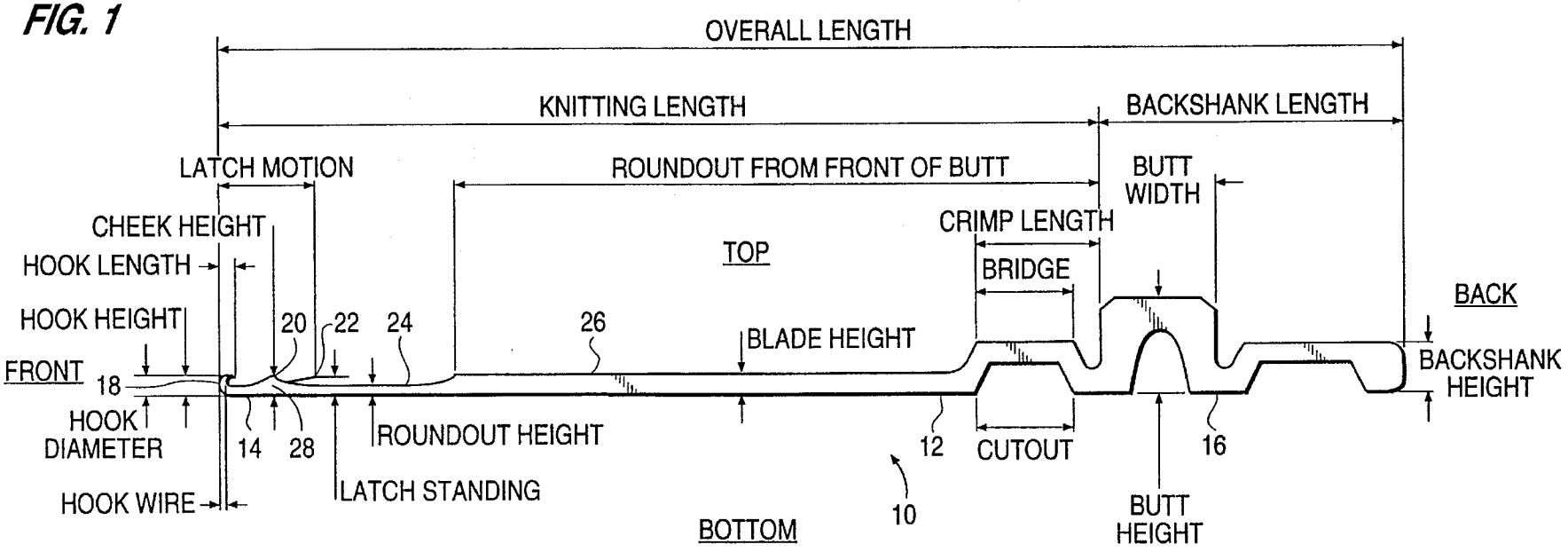
FIG. 1 is a side view of a conventional straight mill knitting needle.

FIG. 1 illustrates a conventional straight mill knitting needle 10. The needle 10 includes a shank 12 having a head portion 14 and a butt end portion 16. The head area portion includes a hook 18, a cheek 20, a latch 22, and a roundout portion 24. Between the head area portion and the butt end portion of the needle is the blade 26. The blade 26 is the portion of the needle which connects the head portion 14 and the butt end portion 16.

The latch 22 is typically concave but this is not required. The latch 22 is pivotally supported by a pivot 28 in the cheek 20. The latch is contained in a groove in the head portion of the needle. The groove is located in the cheek 20 of the needle 10. When the latch 22 is in the open position, the latch 22 is contained in the groove and extends above the roundout portion 24. The roundout portion 24 is typically formed so that it extends from the rear end of the cheek to a point where the blade is at its full blade height. This roundout is such that it extends along a straight plane for a substantial portion of its length.

Figure 2:
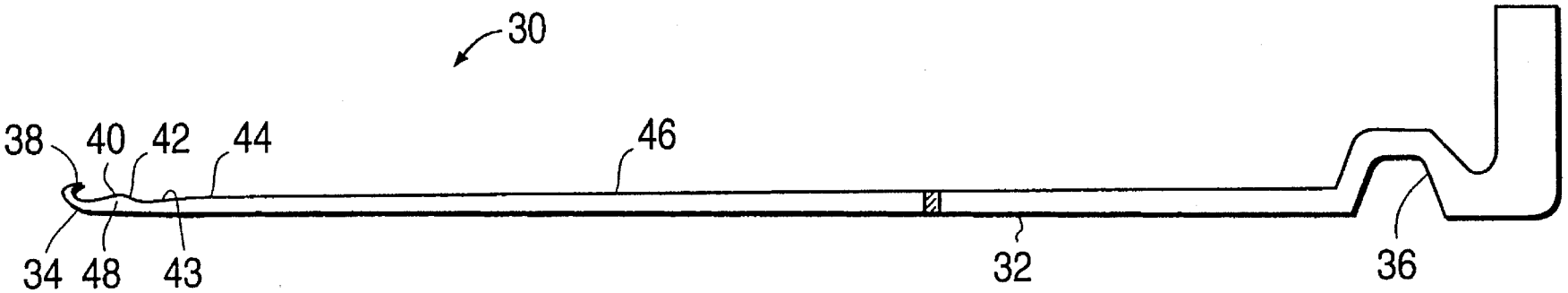
FIG. 2 is an side view of a conventional taper mill knitting needle.

FIG. 2 illustrates a conventional taper mill knitting needle 30. The needle 30 includes a shank 32 having a head portion 34 and a butt end portion 36. The head area portion includes a hook 38, a cheek 40, a latch 42, a round out section 43 which extends along a straight plane from the cheek to where the taper starts and a tapered portion 44. Between the head area portion and the butt end portion of the needle is the blade 46. The blade 46 is the portion of the needle which connects the head portion 34 and the butt portion 36.

The latch 42 is, but need not be, typically concave. The latch 42 is pivotally supported by a pivot 48 in the cheek 40. The latch 42 is contained in a groove in the head portion 34 of the needle. The groove is located in the cheek 40 of the needle 30. When the latch 42 is in the open position, the latch 42 is contained in the groove and its tip extends above the tapered portion 44. The tapered portion 44 is typically formed so that it extends from the rear end of the cheek to a point where the blade is at its full blade height. This tapered portion 44 is such that it extends in a straight plane for its entire length.

Figure 3:
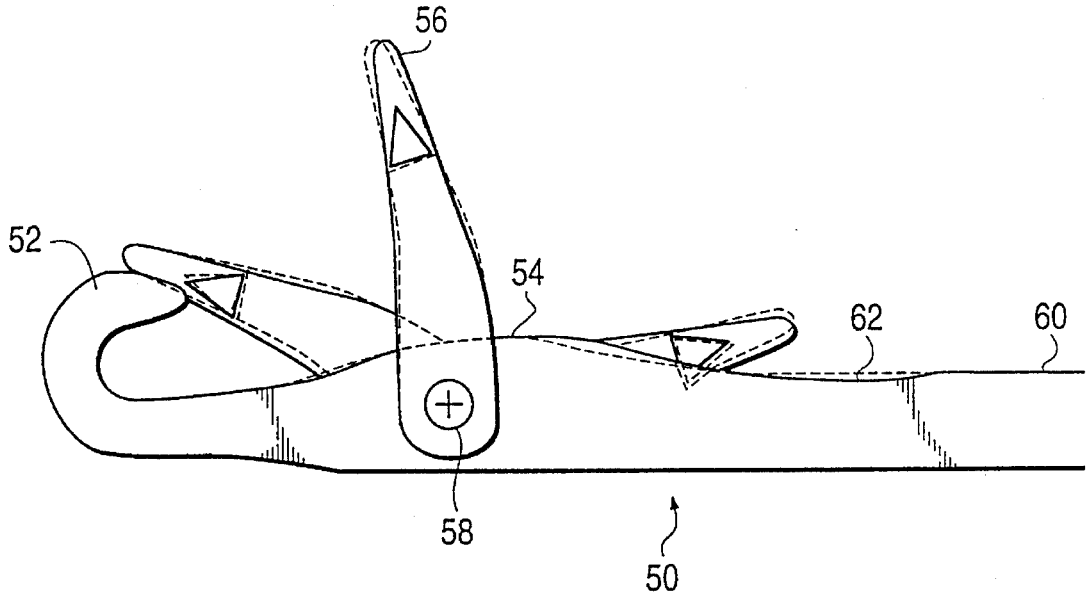
FIG. 3 is an enlarged side view of a head portion of a straight mill knitting needle according to a first embodiment of the invention.

FIG. 3 illustrates an enlarged side view of a first embodiment of the present invention. This drawing shows a straight mill knitting needle 50 in solid black lines and a conventional knitting needle in dashed lines. The needle 50 includes a hook 52, a cheek 54 and a latch 56 shown in three different positions. These positions include the fully closed and fully open positions. The latch 56 is pivotally held in place by a pivot 58.

A portion of the roundout 60 is shown in the drawing. Between the roundout 60 and the cheek 54, a loop tension release notch 62 is located. This notch is typically of a continuous curvature and is preferably located so that the deepest portion of the notch is located in a position close to the longitudinal position of the latch tip when the latch tip is in the fully open position. The notch can also include a short straight portion parallel to the rear of the needle.

The loop tension release notch allows the latch standing position to be lowered compared to the conventional needle while still avoiding spearing. The maximum depth of the loop tension release notch 62 depends on the type of needle being manufactured. For hosiery needles, the preferred maximum depth of the notch is between 0.05 and 0.50 mm. For other garments, the preferred maximum depth of the notch is between 0.1 and 1.50 mm.

Figure 4:
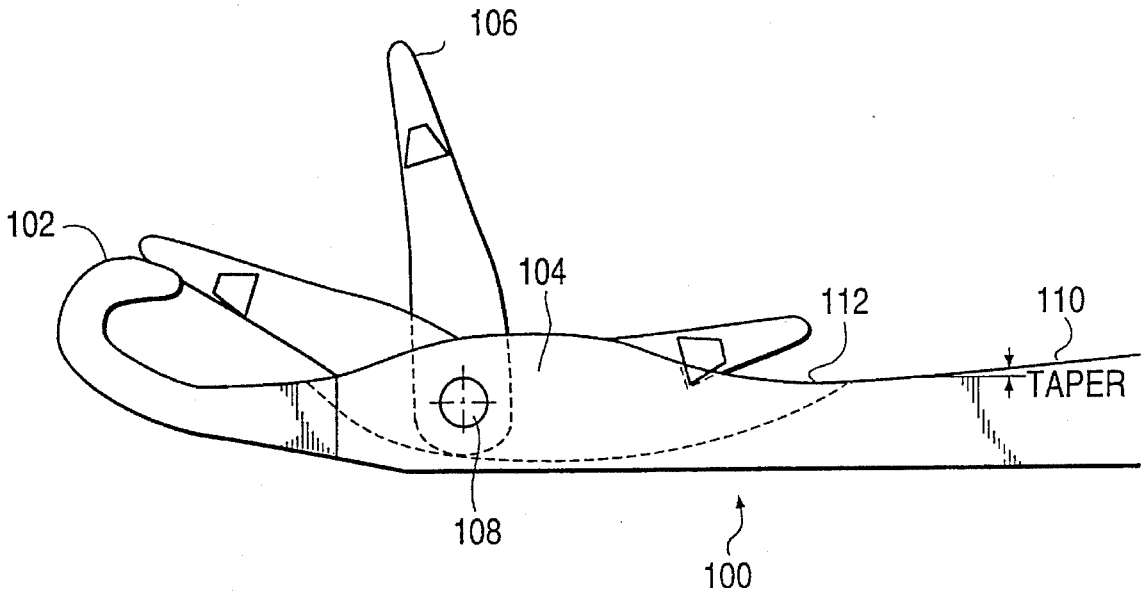
FIG. 4 is an enlarged side view of the head portion of a taper mill knitting needle according to a second embodiment of the invention.

FIG. 4 illustrates an enlarged side view of a second embodiment of the present invention. This drawing shows a taper mill knitting needle 100. The needle 100 includes a hook 102, a cheek 104 and a latch 106 shown in three different positions. These positions include the fully closed and fully open positions. The latch 106 is pivotally held in place by a pivot 108.

A portion of a taper 110 is shown in the figure. Between the taper 110 and the cheek 104, a loop tension release notch 112 is located. This notch is typically of a continuous curvature and is preferably located so that the deepest portion of the notch is located in a position close to the longitudinal position of the latch tip when the latch tip is in the fully open position.

The method of making a knitting needle for knitting machines is also unique. For straight mill needles, this method includes forming a needle having a head portion including a cheek portion and a hook adjacent to the cheek portion, and a blade having a reduced height front side portion parallel to a rear side portion; and forming a loop tension release notch portion between the reduced height front side portion and the cheek portion. The loop tension release notch portion is formed so that it is below a plane formed by the reduced height front side portion.

For taper mill needles, this method includes forming a needle having a head portion including a cheek portion and a hook adjacent to the cheek portion, and a blade having a tapered height front side portion; and forming a loop tension release notch portion between the tapered height front side portion and the cheek portion. The loop tension release notch portion is formed so as to have a continuous curvature.

In both processes, the loop tension release notch can be formed by any of the following processes: stamping, shearing, striking, pressing, milling, grinding, shaving, cutting, sand blasting and chemical metal removal methods. The various cutting methods include laser cutting, electron beam cutting and wire cutting methods.

The knitting needles of this invention are then used in knitting machines for making many different types of fabrics. These materials include hosiery, underwear fabric, outerwear fabric and industrial fabric.

Although the present invention has been fully described by way of example with reference to the accompanying drawings, it is to be understood that various changes and modifications will be apparent to those skilled in the art. Therefore, unless such changes depart from the scope of the invention as defined by this specification and claims, they should be construed as being included herein.

What is claimed is:

1. A knitting needle for knitting machines comprising:

a shank having a head portion, a butt end portion, and a blade therebetween, said head portion having a cheek portion having a maximum height;

a latch pivotally secured in said cheek portion, said latch having a latch tip; and a hook adjacent to said cheek portion;

said blade having a reduced height front side portion parallel to a rear side portion, said reduced height front side portion defining a plane which intersects with said cheek portion in a middle region of the maximum height, wherein the improvement comprises a loop tension release notch portion between said reduced height front side portion and said cheek portion, said loop tension release notch portion being formed below the plane formed by said reduced height front side portion.

2. A knitting needle as defined in claim 1, wherein said loop tension release notch portion is formed by an arc which extends from one side of said cheek portion to said reduced front side portion.

3. A knitting needle as defined in claim 1, wherein said loop tension release notch portion has a depth which is greatest at a location below said latch tip when said latch tip is in an open position.

4. A knitting needle as defined in claim 1, wherein said loop tension release notch portion has a maximum depth ranging from 0.05 mm to 1.5 mm.

5. A knitting needle as defined in claim 1, wherein said loop tension release notch portion has a maximum depth ranging from 0.05 mm to 0.50 mm.

6. A knitting needle as defined in claim 1, wherein said loop tension release notch portion has a maximum depth ranging from 0.1 mm to 1.5 mm.

7. A knitting needle as defined in claim 1, wherein a distance between a maximum depth of said loop tension release notch and said rear side portion is less than 0.55 mm.

8. A knitting needle as defined in claim 1, wherein a distance between a maximum depth of said loop tension release notch and said rear side portion is less than 65% of a height of said cheek.

9. A high speed needle for circular knitting machines, comprising:

a shank having a head portion, a butt end portion, and a blade therebetween, said head portion having a cheek portion having a maximum height;

a latch pivotally secured in said cheek portion, said latch having a latch tip; and a hook adjacent to said cheek portion;

said blade having a reduced height front side portion parallel to a rear side portion, said reduced height front side portion defining a plane which intersects with said cheek portion in a middle region of the maximum height, wherein the improvement comprises a loop tension release notch portion between said reduced height front side portion and said cheek portion, said loop tension release notch portion being formed below a plane formed by said reduced height front side portion, and said loop tension release notch portion has a depth from 0.05 mm to 1.5 mm which is greatest at a location below said latch tip when said latch tip is in an open position.

10. A high speed needle for circular knitting machines, comprising:

a shank having a head portion, a butt end portion, and a blade therebetween, said head portion having a cheek portion;

a latch pivotally secured in said cheek portion, said latch having a latch tip; and a hook adjacent to said cheek portion;

said blade having a top side portion parallel to a rear side portion, a tapered section adjacent to said top side portion, and a portion between said cheek portion and said tapered section, wherein the improvement comprises said portion between said cheek portion and said tapered section being a loop tension release notch portion formed of a continuous curvature,

11. A high speed needle for circular knitting machines as defined in claim 10, wherein said loop tension release notch portion has a depth which is greatest at a location below said latch tip when said latch tip is in an open position.

12. A knitting needle as defined in claim 10, wherein said loop tension release notch portion has a maximum depth ranging from 0.05 mm to 1.5 mm.

13. A knitting needle as defined in claim 12, wherein said loop tension release notch portion has a maximum depth ranging from 0.05 mm to 0.50 mm.

14. A knitting needle as defined in claim 12, wherein said loop tension release notch portion has a maximum depth ranging from 0.1 mm to 1.5 mm.

15. A knitting needle as defined in claim 12, wherein a distance between a maximum depth of said loop tension release notch and said rear side portion is less than 0.55 mm.

16. A knitting needle as defined in claim 12, wherein a distance between a maximum depth of said loop tension release notch and said rear side portion is less than 65% of a height of said cheek.

17. A method for making a knitting needle for knitting machines comprising the steps of:

forming a needle having a head portion including a cheek portion and a hook adjacent to the cheek portion, and a blade having a reduced height front side portion parallel to a rear side portion, the reduced height front side portion defining a plane which intersects with said cheek portion in a middle region of a maximum height of said cheek portion; and forming a loop tension release notch portion between the reduced height front side portion and the cheek portion, the loop tension release notch portion being formed below a plane formed by the reduced height front side portion.

18. A method for making a knitting needle as defined in claim 17, wherein said step of forming the loop tension release notch portion is accomplished by using a cutter.

19. A method for making a knitting needle as defined in claim 17, wherein said step of forming the loop tension release notch portion is performed prior to a step of attaching a latch to the cheek portion.

20. A method for making a knitting needle as defined in claim 17, wherein said step of forming the loop tension release notch is performed by at least one of striking, pressing, milling, grinding and cutting.

21. A method for making a knitting needle for high speed circular knitting machines comprising the steps of:

forming a needle having a head portion including a cheek portion and a hook adjacent to the cheek portion, and a blade having a tapered height front side portion; and forming a loop tension release notch portion between the end of the tapered height front side portion and the cheek portion so as to have a continuous curvature.

22. A method for making a knitting needle as defined in claim 21, wherein said step of forming the loop tension release notch portion is accomplished by using a cutter.

23. A method for making a knitting needle as defined in claim 21, wherein said step of forming the loop tension release notch portion is performed prior to a step of attaching a latch to the cheek portion.

24. A method for making a knitting needle as defined in claim 23, wherein said step of forming the loop tension release notch is performed by at least one of striking, pressing, milling, grinding and cutting.

* * * * *